US005282616A

United States Patent [19]

Stacavich-Notaro

[11] Patent Number: 5,282,616

[45] Date of Patent: Feb. 1, 1994

[54] GOLF BALL MARKER

[76] Inventor: Marylou I. Stacavich-Notaro, 145 74th St., Brooklyn, N.Y. 11209

[21] Appl. No.: 3,645

[22] Filed: Jan. 13, 1993

[51] Int. Cl.[5] ..... A44B 17/00; A41D 25/04; A63B 57/00

[52] U.S. Cl. ..... 273/32 A; 24/49 P; 24/306; 273/DIG. 30

[58] Field of Search ..... 273/32 A, 162 D, 32 R, 273/32 B, DIG. 30; 24/49 P, 306, 442

[56] References Cited

U.S. PATENT DOCUMENTS

| | | | |
|---|---|---|---|
| 1,830,936 | 11/1931 | Faith | 273/32 A X |
| 2,979,335 | 4/1961 | Pruitt | 273/162 D |
| 3,405,408 | 10/1968 | Baker | 24/49 CP X |
| 3,847,110 | 11/1974 | Inoue | 273/32 R |
| 3,851,357 | 12/1974 | Ribich et al. | 24/306 |
| 3,895,797 | 7/1975 | Moore | 273/32 A |
| 3,938,805 | 2/1976 | Sakuma | 273/32 A |
| 4,554,710 | 11/1985 | Grant | 24/49 CP X |
| 4,822,052 | 4/1989 | Dimmick et al. | 273/32 A X |
| 4,835,821 | 6/1989 | Durante | 24/306 X |
| 5,031,812 | 7/1991 | Gustine | 273/32 A X |
| 5,143,371 | 9/1992 | Strahan | 273/32 B |

*Primary Examiner*—George J. Marlo
*Attorney, Agent, or Firm*—Robert C. Beam

[57] ABSTRACT

The present invention shows a golf ball marker is shown in which a marker component, a disk of plastic or metal or some other material, may be provided with some element of decoration on its top surface. The marker component also has a layer of one part of hook and loop binder material on its bottom surface. The bottom surface may also be pierced by a peg or post at its center, to the secure the Marker's position when in use on a putting green.

The golf ball marker also has an attachment component which is, at least in part, a second disk having its top surface provided with the second and mating part of hook and loop binder material. This attachment component may be attached to any convenient object, such as the handle of a golf putter or a hat or glove. This attachment component may also be provided with a tie tack attachment means for attachment to the user's clothing.

1 Claim, 1 Drawing Sheet

GOLF BALL MARKER

BACKGROUND OF THE INVENTION

1. Field of the Invention

The present invention relates to markers used i the position of a player's ball in the game of golf. In particular, the present invention relates to a golf ball marker comprising:

a) a marker component, said marker component itself comprising a disk of some suitable material having:
   i) a top surface having an element of decoration; and,
   ii) a bottom surface provided with a layer of one part of hook and loop binder material; and, b) an attachment component, said attachment component comprising, at least in part, a second disk having:
   i) a top surface provided with the second and mating portion of said hook and loop binder material; and,
   ii) attachment means suitable for attaching said attachment component to a suitable surface.

2. Description of Related Art

During the play of the game of golf, it often happens that a player closer to the hole on a putting green is required to move his ball aside to permit a player lying farther from the hole to putt. In doing so, it is common for the player to put a marker, usually a small disk, such as a coin or the like, where his ball had been.

While any small coin or similar object will serve this purpose, golfers appear to take pride in having some valuable or sentimental object to use for this purpose. Unfortunately, during the course of play, there is some danger that such an object will be lost.

U.S. Pat. No. 5,143,371 to Strahan is entitled GOLFER S AID. This reference shows a device which clips onto the belt of a golfer, and which is provided with a portion of hook and loop fabric which will enable to wearer to attach the user's golf glove. In addition, the device is provided with a rotatable blade useful in repairing damage to greens, cleaning club heads, and checking golf balls for roundness.

U.S. Pat. No. 5,031,812 to Gustine is entitled GOLF BALL MARKER, CARRYING POUCH AND SUPPORT. This reference shows a device detachably secured to a golfer's belt or golf bag. As shown, the device includes a marker 15 provided with a hook and loop backing which is attached to the device.

U.S. Pat. No. 4,822,052 to Dimmick and Lockeruan is entitled GOLF CLUB GRIP ATTACHMENT FOR IDENTIFICATION AND BALL POSITION MARKING. This reference shows a device which can be attached to the handle of one or more of a user's golf clubs. The device comprises an identification marker integrated into a golf ball marker by a snap-type fastener. The ball marker is provided with an enlarged conical head which acts as an anchor member when forced through the vent hole of a golf club grip.

U.S. Pat. No. 3,938,805 to Sakuma is entitled GOLF ACCESSORY. This reference shows a greens marker provided with hook and loop fastening material, a retaining element secured to a base member, which may be adhered to a suitable position by a layer of pressure-sensitive adhesive.

U.S. Pat. No. 3,895,797 to Moore is entitled GOLF BALL MARKER. This reference shows a device for marking the position of a golf ball on a putting green in which the top surface of the marker is provided with a layer of hook and loop material. When not in use, one or more of the markers may be secured to a pad of such material affixed to a convenient location by a pressure-sensitive material.

U.S. Pat. No. 3,847,110 to Inoue is entitled GOLF SCORE INDICATOR. This reference shows a device for keeping track of a golfer's strokes with a counting disk held in place by a hook and loop arrangement.

U.S. Pat. No. 2,979,335 to Pruitt is entitled COMBINATION GOLF CLUB AND MAGNETICALLY HELD MARKER. This reference shows a ball marker disk held in place on the handle of a golf putter by a magnet secured to the end of the club shaft.

U.S. Pat. No. 1,830,936 to Faith is entitled INITIAL OR MONOGRAM CAP FOR GOLF CLUB SHAFTS. This reference shows a monogrammed or decorative end cap provided for the handles of golf clubs. It does not appear to show markers.

SUMMARY OF THE INVENTION

It is an object of the present invention to provide a golf ball marker having a design element which will not be easily lost.

It is a further object of the present invention to provide a golf ball marker having a design element which can be displayed on a golfer's clothing or equipment.

The other objects, features and advantages of the present invention will become more apparent .in light of the following detailed description of the preferred embodiment thereof.

According to a preferred embodiment of the present invention, there is provided a golf ball marker comprising:

a) a marker component, said marker component itself comprising a disk of some suitable material having:
   i) a top surface having an element of decoration; and,
   ii) a bottom surface provided with a layer of one part of hook and loop binder material; and, b) an attachment component, said attachment component comprising, at least in part, a second disk having:
   i) a top surface provided with the second and mating portion of said hook and loop binder material; and,
   ii) attachment means suitable for attaching said attachment component to a suitable surface.

According to another embodiment of the present invention, there is provided a golf ball marker comprising:

a) a marker component, said marker component itself comprising a disk of some suitable material having:
   i) a top surface having an element of decoration; and,
   ii) a bottom surface provided with a layer of one part of hook and loop binder material and wherein said bottom surface may also be pierced by a peg or post at its center, to the secure the Marker's position in the grass of a putting green when in use; and, b) an attachment component, said attachment component comprising, at least in part, a second disk having:
   i) a top surface provided with the second and mating portion of said hook and loop binder material; and, ii) attachment means suitable for attaching said attachment component to a suitable surface.

According to still another embodiment of the present invention, there is provided a golf ball marker comprising:

a) a marker component, said marker component itself comprising a disk of some suitable material having:
   i) a top surface having an element of decoration; and,
   ii) a bottom surface provided with a layer of one part of hook and loop binder material; and,
b) an attachment component, said attachment component comprising, at least in part, a second disk having:
   i) a top surface provided with the second and mating portion of said hook and loop binder material; and,
   ii) attachment means in the form of a post and frictional binder cap, wherein said post is provided with a pointed end capable of piercing the fabric of a user's clothing, and said frictional binder cap is capable of engaging said post, providing suitable attachment to a said clothing.

DETAILED DESCRIPTION OF THE PREFERRED EMBODIMENT

As noted previously, during the play of the game of golf, it often happens that a player closer to the hole on a putting green is required to move his ball aside to permit a player lying farther from the hole to putt. In doing so, it is common for the player to put a marker, usually a small disk, such as a coin or the like, where his ball had been.

While any small coin or similar object will serve this purpose, golfers appear to take pride in having some valuable or sentimental object to use for this purpose. Unfortunately, during the course of play, there is some danger that such an object will be lost.

Figure 1A:
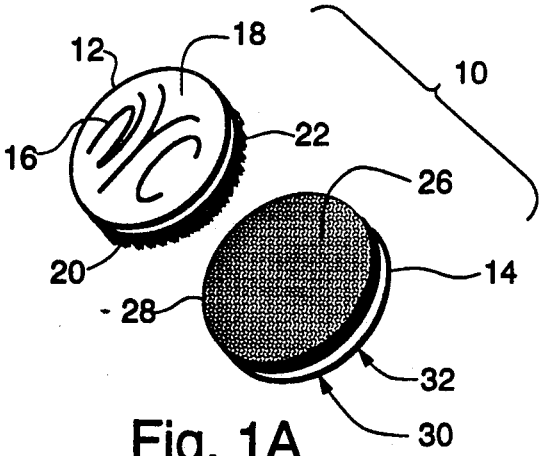
FIG. 1A shows one embodiment of the present invention.
Figure 1B:
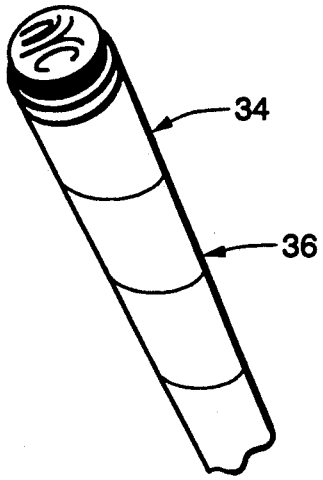
FIG. 1B shows the embodiment of FIG. 1A as it might appear in position on an object such as a golf club.

In the present invention, as shown in FIG. 1A, a golf ball marker 10 is shown. The golf ball marker 10 of the present invention is comprised Of a marker component 12 and an attachment component 14. The marker component 12 may be a disk of plastic or metal or some other suitable material. The marker component 12, as shown, may be provided with some element of decoration 16 on its top surface 18. The marker component 12 is also provided with a layer 20 of one part of hook and loop binder material on its bottom surface 22.

As noted, the golf ball marker 10 of the present invention is further comprised of an attachment component 14. In the illustrated embodiment, the attachment component 14 is provided with a mating layer 26 of hook and loop material on its top surface 28. The bottom surface 30 is provided with some form of attachment means 32, which may be a pressure sensitive adhesive, a permanent mastic of some kind, or some similar suitable method of attachment.

As shown in FIG. 1A, the golf ball marker 10 of the present invention may be affixed to some convenient location. In the illustrative drawing, the golf ball marker lo of the present invention is shown affixed to the handle 34 of a golf club 36, preferably the putter, which is normally used on the putting green.

Figure 2:
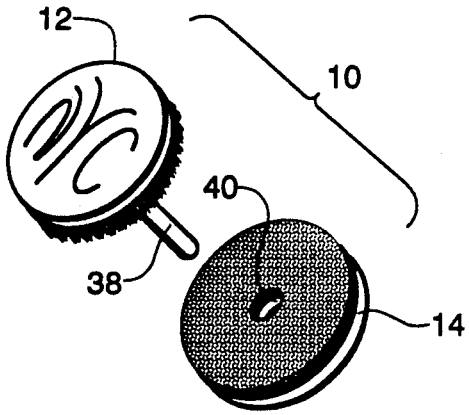
FIG. 2 shows another embodiment of the present invention.

As shown in FIG. 2, the marker component 12 may also be provided with a peg or post 38 at its center. Such a peg or post 38 is common is markers of this kind, to the secure the position of the marker when in use on a putting green. Where such a peg or post 38 is present, however, the attachment component 14 should be provided with an accommodating opening 40 and the location to which the golf ball marker 10 is affixed must be selected to accommodate the peg or post 38.

Figure 3A:
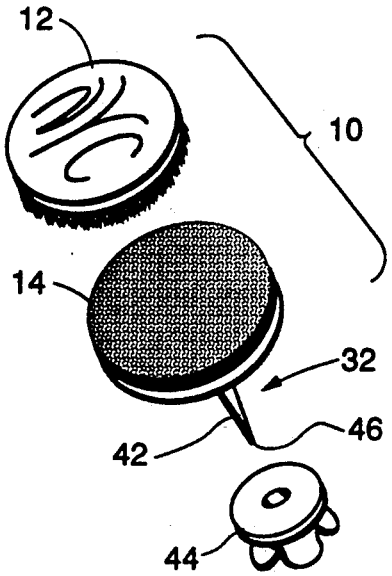
FIG. 3A shows still another embodiment of the present invention.

As shown in FIG. 3A, the golf ball marker 10 of the present invention may also comprise a tie tack arrangement. That is, the attachment component 14 may be further provided with an attachment means 32 comprising a post 42 and a frictional binder cap 44. The post 42 is provided with a pointed end 46 capable of piercing the fabric of a user's clothing, and the frictional binder cap 44 is capable of engaging post 42, providing suitable attachment to said clothing.

Figure 3B:
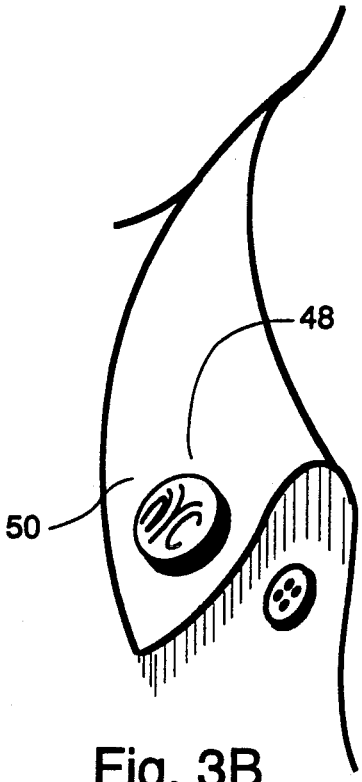
FIG. 3B shows the embodiment of FIG. 3A as it might appear in position on a article of clothing, such as the collar of a golfer's shirt.

Use of the embodiment shown in FIG. 3A is illustrated in FIG. 3B. In that illustration, the golf ball marker 10 of the present invention is shown affixed to the fabric 48 of the collar 50 of the shirt of a golfer.

In use, the marker component 12 of any of the above embodiments, would be separated from the attachment component 14 by breaking the grasp of the hook and loop binder material. The marker component 12 would then be placed in position on the putting surface of a putting green on a golf course to mark the position of a players golf ball. When the player's turn comes, the marker component 12 would be retrieved, and returned to its position bound by the hoop and loop binder material to the attachment component 14, before the player replaces his ball on the green and makes his or her putt.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A golf ball marker comprising:

a) a marker component, said marker component itself comprising a disk of some suitable material having:
   i) a top surface having an element of decoration; and,
   ii) a bottom surface provided with a layer of one part of hook and loop binder material; and,
b) an attachment component, said attachment comprising, at least in part, a second disk having:
   i) a top surface provided with the second and mating portion of said hook and loop binder material; and,
   ii) attachment means in the form of a post and frictional binder cap, wherein said post is provided with a pointed end capable of piercing the fabric of a user's clothing, and said frictional binder cap is capable of engaging said post, providing suitable attachment to a said clothing.

* * * * *